US005085014A

United States Patent [19]

Sandhof

[11] Patent Number: 5,085,014

[45] Date of Patent: Feb. 4, 1992

[54] HONING TOOL AND METHOD FOR THE SURFACE MACHINING OF BORE WALLS

[75] Inventor: Gerhard Sandhof, Leinfelden-Echterdingen, Fed. Rep. of Germany

[73] Assignee: Maschinenfabrik Gehring GmbH & Co., Ostfildern, Fed. Rep. of Germany

[21] Appl. No.: 564,858

[22] Filed: Aug. 9, 1990

[30] Foreign Application Priority Data

Aug. 25, 1989 [EP] European Pat. Off. ..... 89115678.8

[51] Int. Cl.[5] ..... B24B 1/00

[52] U.S. Cl. ..... 51/290; 51/330; 51/331; 51/349

[58] Field of Search ..... 51/330, 331, 351, 352, 51/364, 34 J, 34 H, 206 P, 349, 372, 373, 354, 290

[56] References Cited

U.S. PATENT DOCUMENTS 1,865,229 6/1932 Birgbauer ..... 51/351
1,960,555 5/1934 Sims ..... 51/372
2,170,329 8/1939 Hoke ..... 51/262 R
2,312,011 2/1943 Wallace ..... 51/349
2,795,089 6/1957 Seborg ..... 51/349 X
4,188,755 2/1980 Fitzpatrick ..... 51/206 P
4,199,903 4/1980 Fitzpatrick ..... 51/364 X

FOREIGN PATENT DOCUMENTS 3719796 6/1987 Fed. Rep. of Germany .
WO83/02913 9/1983 PCT Int'l Appl. ..... 51/331

*Primary Examiner*—M. Rachuba
*Attorney, Agent, or Firm*—Foley & Lardner

[57] ABSTRACT

A honing tool is used for the surface machining of the cylinder working surfaces of cylinder bores of an internal combustion engine. In order to obtain a uniform plateau texture over the entire surface of the cylinder bore, working elements are provided which can be brought to bear under radial pressure against the bore wall. The working elements are designed as honing rings, which are mounted in the tool like piston rings. The honing rings are arranged roughly coaxially to the longitudinal axis of the honing tool.

15 Claims, 2 Drawing Sheets

HONING TOOL AND METHOD FOR THE SURFACE MACHINING OF BORE WALLS

BACKGROUND OF THE INVENTION

The invention relates to a honing tool for the surface machining of bore walls, in particular, the cylinder working surfaces of cylinder bores of an internal combustion engine. Such a honing tool typically consists of a tool body having at least one working element which can be brought to bear under radial pressure against the bore wall.

In the honing of bore walls, the surface properties of the walls, on the one hand, should have a certain roughness in order to ensure a stable lubricating film, but, on the other hand, should have a favorable sliding behavior. Therefore, a rough surface profile is required to obtain a stable lubricating film, whereas as fine a surface as possible is necessary for a favorable sliding behavior, which surface should, in addition, be free from surface deformations (in technical usage, a bore having such surface deformations is designated as "smeared metal").

In order to meet these conflicting requirements, surface machining is typically carried out with a so-called plateau honing tool. This tool, belonging to the generic category of stick honing tools, has axially extending honing sticks which are arranged in a distributed manner at the periphery of the tool body and are pressed radially outward by a feed mechanism against the surface to be machined. Provided in a plateau honing tool are sets of honing sticks which work independently of one another and which are individually controlled via a double feed system. In a first operating cycle, the basic texture having a rough surface profile is produced with the first coarse-grained set of sticks, then the raised profile peaks are removed with the second finer-grained set of sticks until a so-called plateau texture is achieved. A plateau surface of this type has a fine, load-bearing texture, the plateau of which is interrupted periodically at short intervals by substantially deeper scores in the basic texture.

Surface machining carried out with a plateau honing tool can also be carried out with two separate stick honing tools, coming into use one after another. However, it has been found that the desired plateau texture is not achieved uniformly over the entire surface. After the honing of the basic texture, unavoidable residual defects remain in the macrogeometry, i.e., cylinder shape, roundness and straightness of the bore. Due to the geometric dimensions (length and width) of the axially extending honing sticks, these honing sticks cannot adequately adapt themselves to the macroform of the bore, which is why uniform removal of the raised profile peaks over the entire surface of the bore is not achieved.

SUMMARY OF THE INVENTION

An object of the invention is to create a honing tool of a simple construction with which a uniform plateau texture can be produced over the entire surface of a bore wall.

In accordance with one aspect of the invention, the honing tool includes a tool body and at least one working element mounted on the tool body and adapted to be brought under radial pressure into engagement with the bore wall. The working element comprises a honing ring arranged generally coaxially to a longitudinal axis of the honing tool.

In accordance with another aspect of the invention, a plurality of the honing rings are spaced equidistant from one another along an axial surface of the tool body. Each honing ring is mounted with an axially close clearance in an annular groove formed in the periphery of the tool body coaxially to the longitudinal axis. The honing ring may include an abrasive layer or bristles located on its outer periphery.

In accordance with yet another aspect of the invention, a hydraulic feed mechanism may be provided which is adapted to apply the pressure to the honing ring. The honing tool body may have an inner bore formed therein which is adapted to supply coolant from the hydraulic feed mechanism to an annular channel formed at a base of the annular groove, and to discharge the coolant under pressure through a fitting gap located between the honing ring and the annular groove.

In accordance with another aspect of the invention, an enshrouding cylinder may be arranged coaxially with the cylindrical bore. The enshrouding cylinder has a frusto-conical shaped section adapted to adjust the diameter of the honing ring to be approximately equal to that of the cylindrical bore before insertion of the honing tool into the cylindrical bore.

Another object of the invention is to provide a method of machining a surface of a cylindrical bore. In accordance with one aspect of the invention, the method includes the steps of inserting a honing tool body into the bore, applying radial pressure on a honing ring, mounted in an annular groove formed in a peripheral surface of the tool body coaxially to a longitudinal axis of the honing tool, to force the working element into engagement with the bore wall, and rotating the tool body within the cylindrical bore to machine the surface.

In accordance with another aspect of the invention, the step of applying radial pressure includes the step of feeding a hydraulic fluid, which may comprise a coolant, to the honing ring from a hydraulic feed mechanism. The coolant is fed through an inner bore of the tool body, an annular channel formed at a base of the annular groove, and through a fitting gap located between the honing ring and the annular groove.

In accordance with another aspect of the invention, a further step includes adjusting the diameter of the honing ring to be approximately equal to that of the cylinder bore, before inserting the honing tool into the cylinder bore, by forcing the tool body through a frusto-conical shaped section of an enshrouding cylinder arranged coaxially with the cylinder bore.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

DETAILED DESCRIPTION OF THE PREFERRED EMBODIMENTS

Good positive bearing against a bore wall is achieved by a piston-ring-like design of the working elements (honing rings). The honing tool according to the invention is used in two-stage machining with separate honing tools and is especially well suited for removing the raised profile peaks of the basic texture produced with another tool, so that a uniform plateau texture is achieved over the entire surface of the bore wall.

A plurality of honing rings are preferably arranged next to one another in the axial direction of the tool body, the honing rings, for example, being axially equidistant from one another. Each honing ring is of a self-locking and split construction so that it bears with a uniformly acting surface pressure against the wall of the workpiece bore. This promotes good adaptation to the shape of the cylinder wall.

The honing tool according to the invention is of a simple construction and requires no separate feed mechanism, since the honing rings, on account of their configuration, bear under a uniformly acting surface pressure against the bore wall of the workpiece. Thus, the tool body plus the honing rings essentially represents a reproduction of a piston plus it s associated piston rings, which is advantageous in the honing of cylinder bores of an internal combustion engine. By carrying out a plateau honing operation with the honing tool according to the invention, the insertion of the piston in the cylinder bore is, as it were, anticipated, and a cylinder bore surface suitable for the function is created.

Figure 1:
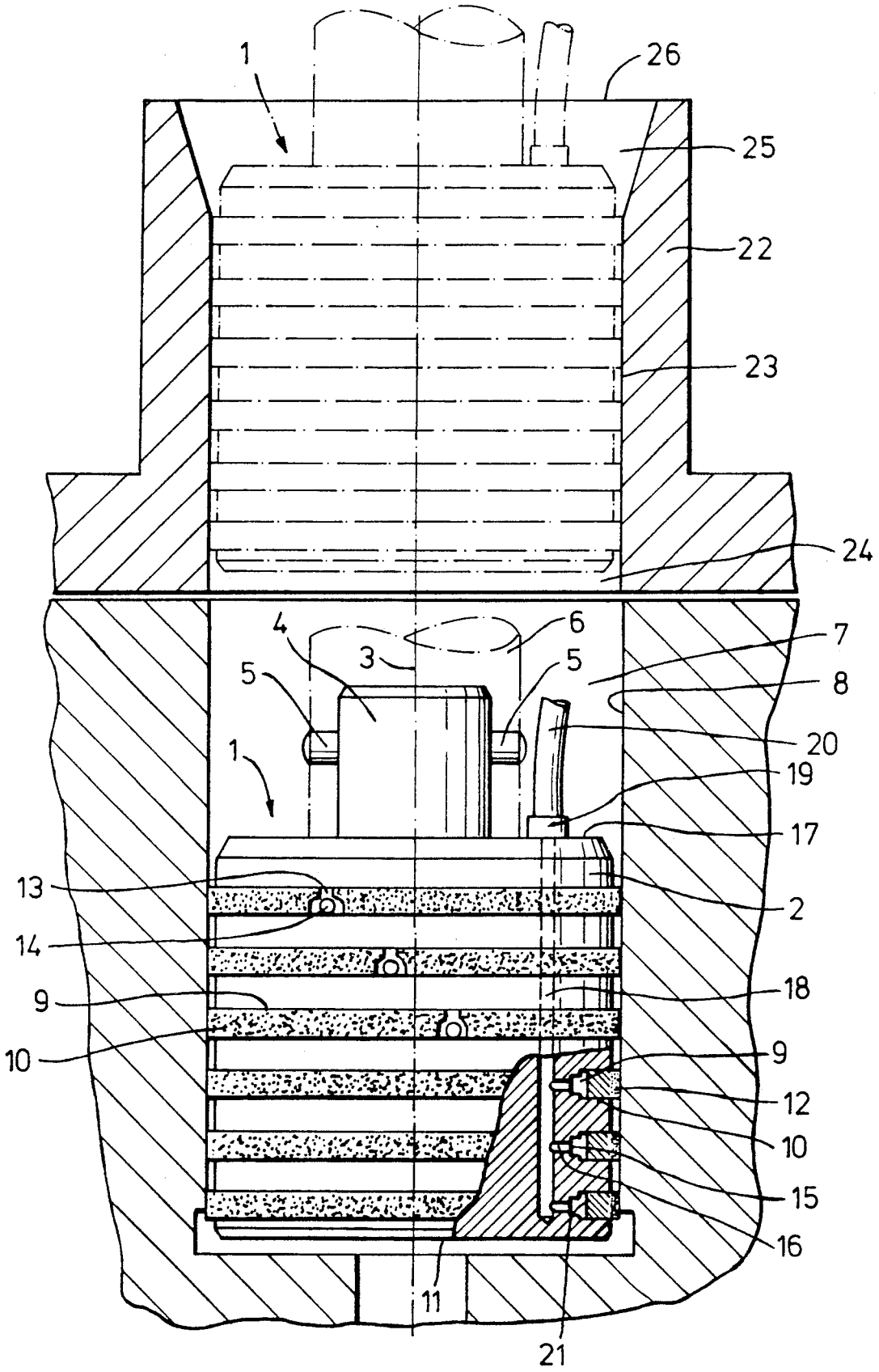
FIG. 1 shows a schematic section through a bore to be hone a honing tool according to the invention in partial section.
Figure 2A:
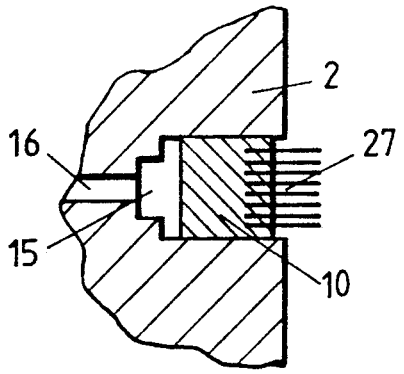
FIG. 2*a* shows a section through an individual honing ring fitted with bristles.
Figure 2B:
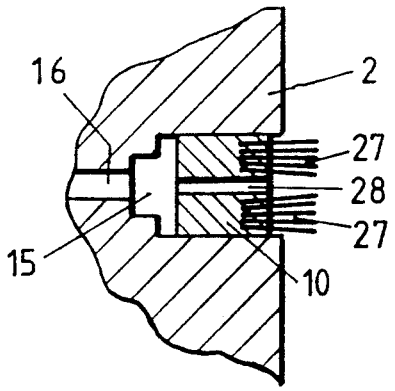
FIG. 2*b* shows a section according to FIG. 2*a* with a coolant bore.
Figure 3:
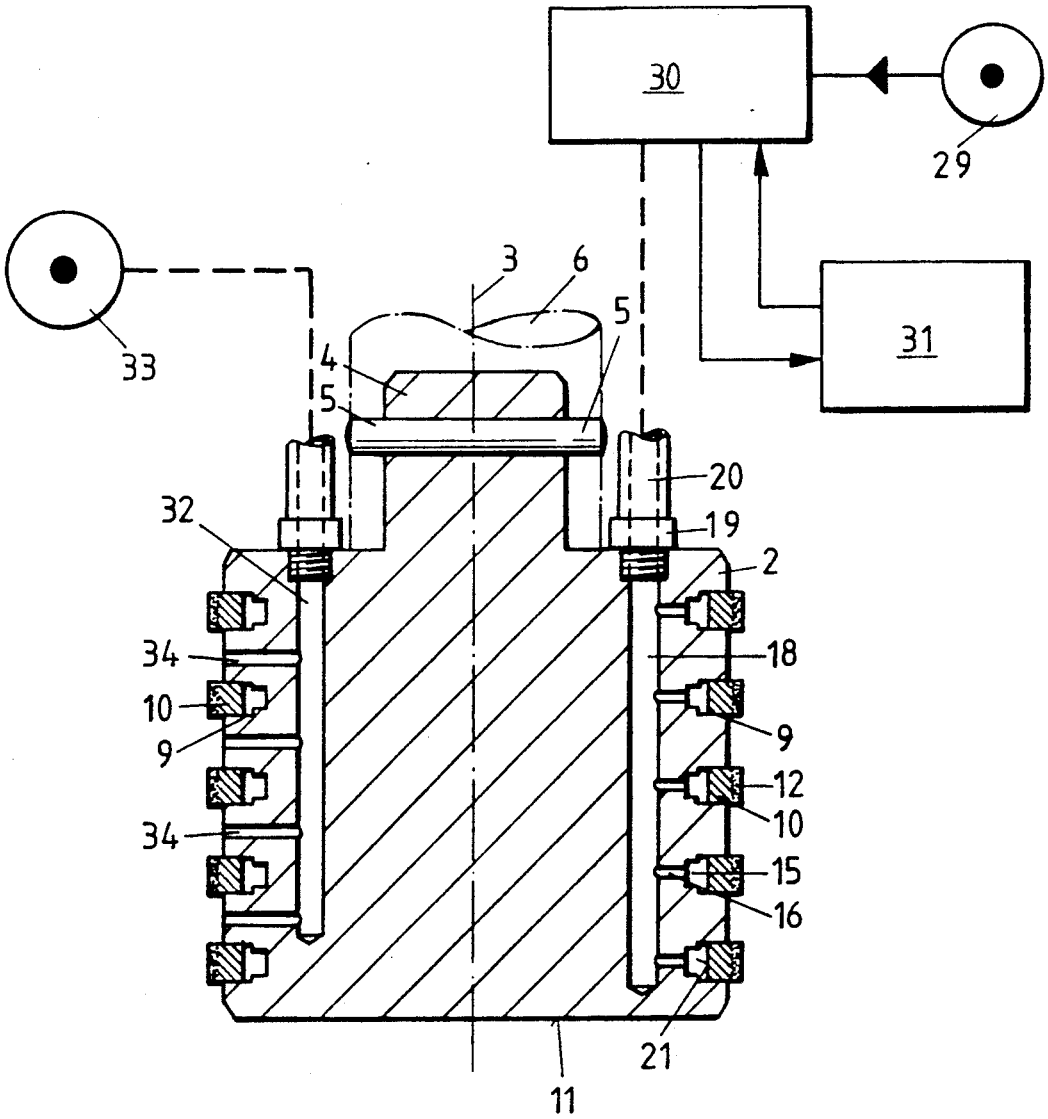
FIG. 3 shows an axial section through a honing tool according to the invention.

Referring to FIGS. 1-3, the honing tool 1 has a tool body 2 which is essentially rotationally symmetrical to, i.e., co-axial with, the tool longitudinal axis 3, and is provided at one end with an axial journal extension 4 of smaller diameter. The journal extension 4 has pin projections 5 extending laterally therefrom. The journal extension 4, with the pin projections 5, is inserted in a bayonet-like connection into a drive rod 6 of a corresponding design, which is indicated by dash-dotted lines. The drive rod 6 is rotationally driven by a honing drive (not shown in more detail). A cylinder wall 8 of a workpiece bore 7, which, for example, can be designed as a blind bore, is machined with the honing tool 1 according to the invention.

In its periphery, the cylindrical tool body 2 has annular grooves 9 running coaxially to the tool longitudinal axis 3, in which annular working elements 10, namely honing rings, are held. The honing rings 10 are fitted into the annular grooves with an axially close clearance. In the exemplary embodiment, six annular grooves 9 are provided with honing rings 10, which are arranged on the tool body 2 in such a way as to follow one another at a distance in the axial direction. In this arrangement, the distance between the last honing ring 10 and the lower free end 11 of the tool body 2 is kept very small so that the cylinder wall 8 can be machined down to the undercut at the bottom of the bore. The distances between the adjacent honing rings 10 can be the same and are preferably larger than the distance between the lower honing ring 10 and the free end 11.

Each honing ring 10 is of a self-locking and split construction and has the shape of an open annular spring, i.e., a resilient ring, of a rectangular transverse cross section. At their outer periphery, the honing rings 10 have an abrasive layer 12 consisting, for example, of bonded diamond grain. Instead of providing the honing rings 10 with an abrasive layer 12, it can be advantageous to provide one or more honing rings 10 partly or completely with bristles 27, as shown in FIGS. 2*a* and 2*b*. In order to obtain an increased coolant flow to the machined surface, a coolant bore 28 in the honing ring 10 is advantageously provided.

On account of their configuration, the honing rings, after the honing tool 1 is advanced into the workpiece bore 7, bear with a predetermined and uniformly acting surface pressure against the cylinder wall 8, as illustrated in FIG. 1. The bearing pressure is achieved by the elasticity and shape of the honing rings 10, which are held like piston rings on the tool body 2 and run in the bore 7.

A continuous axial slit of each honing ring 10 forms a joint 13 which is provided with a recessed portion. A pin 14, tightly seated in the groove root of the annular groove 9 carrying the honing ring 10, engages into the recessed portion of the tool body 2. As a result, each honing ring 10 is held on the tool body 2 in such a way as to be locked in rotation with respect to the tool body. The anti-rotation locking arrangement of each honing ring 10 is offset in the peripheral direction relative to the anti-rotation locking arrangements of the other honing rings.

The honing tool 1 is preferably provided with an inner coolant supply for flushing and cooling the working surfaces. A depression which forms an encircling annular channel 15 is made at the base of each annular groove 9. A radial bore 16 leads from each annular channel 15 to a common blind bore 18. The latter runs axially from the upper end face 17 of the tool body 2, and, at its open end on the end face 17, has a nipple 19 which is connected to a hose line 20. As shown in FIG. 3, the hose line 20 is connected in a known manner, for example, via a ring distributor, to a coolant pressure source 29 which, via a hydraulic control device 30, feeds the bores 16 and 18 as well as the annular channel 15 with a hydraulic coolant or pressure medium. The hydraulic control device 30 is activated in a controlled manner by an electronic control system 31, preferably an NC-unit. The hydraulic pressure in the annular chambers 15 is set via the NC-unit 31, which is integrated in the complete machine and the control device 30, as a result of which the bearing pressure of the honing rings 10 can be regulated.

During the operation of the honing tool, the coolant passes through the hose line 20, the blind bore 18, and the bores 16 into the annular channel 15 in order to flow out from there through a fitting gap formed between the honing ring 10 and the annular groove 9 and onto the surface to be machined. At an appropriate coolant pressure, the abrasive grit is thus flushed away from the machined surface to the outside. To this end, it can be advantageous to provide in the honing rings 10 further apertures or openings in the form of coolant bores 28 for a greater outflow of coolant to the machined surfaces.

The coolant at the same time exerts a hydraulic pressure against the inner annular surface 21 of each honing ring 10, pressing each honing ring 10 against the cylinder wall 8 of the workpiece bore 7. Specific feed of the honing rings 10 can be effected in a simple manner via the coolant supply to the honing tool 1. The surface pressure, with which the honing rings 10 work, can be preset or specifically varied during the machining by appropriate selection of the coolant pressure. If such a hydraulically acting feed of the honing rings is provided, honing rings 10 without a self-locking feature can also be used.

As shown in FIG. 1, the honing tool 1 conveniently cooperates with an enshrouding cylinder 22 which is provided directly above the entry orifice of the workpiece bore 7. The enshrouding cylinder 22 has a bore 23 which is in alignment with the workpiece bore 7 and consists of a cylindrical section 24. The top end 26 of section 24, i.e., the end remote from the workpiece, adjoins a frusto-conical shaped section 25 which widens towards the top end 26. The section 24 has approximately the specified diameter of the workpiece bore 7, whereas the frusto-conical shaped section has a maximum diameter which is greater than the outside diameter of the unstressed honing rings 10.

At the start of a honing operation, the honing tool 1 is lowered from an upper end position in the direction of the workpiece bore 7, the tool body first advancing into the enshrouding cylinder 22. As a result, the honing rings 10 are elastically compressed radially via contact with the frusto-conical shaped section 25 of the bore 23 approximately to the specified size of the workpiece bore 7, and are thus preloaded. At the same time, the honing tool 1 is oriented and guided relative to the workpiece axis 3. Guided accurately in such a way, the honing tool 1 advances into the rough-machined workpiece bore 7, the diameter of which is the same as or a few thousandths of a millimeter smaller than that of the cylindrical section 24 of the enshrouding cylinder 22.

After the workpiece has been machined, the honing tool moves completely out of the workpiece bore 7, but preferably only into a position in which the lower tool edge has just left the workpiece bore. The length of the cylindrical section 24 of the bore 23 of the enshrouding cylinder 22 can be selected in such a way that all honing rings 10 lie within the section 24 in this tool position, shown by dash-dotted lines in the drawing in FIG. 1. Thus, the honing rings also remain preloaded during a tool change, and a rapid readvance into the next workpiece is ensured.

If the tool 1 is provided with an additional high-pressure liquid-jet device as described in German Offenlegungsschrift 3,719,796, the disclosure of which is incorporated herein by reference, a combined honing, jetting, and brushing treatment of the cylinder wall 8 can be carried out according to the method disclosed in German Offenlegungsschrift 3,719,796. As shown in FIG. 3, a high-pressure liquid source 33 is connected to one or more axial blind bores 32 which are provided in addition to the blind bores 18, and are not connected to the latter. The blind bore 32 is connected to radial nozzle bores 34 which open out at the periphery of the honing tool. Each bore 34 is preferably situated between successive honing rings 10. The jet of each bore 34 is therefore directed radially directly onto the machined surface.

What is claimed is:

1. A honing tool for machining a wall of a cylindrical bore, said honing tool comprising:

a tool body having a longitudinal axis and formed with a plurality of axially spaced grooves having bottom at the radially inner ends thereof;

a plurality of honing rings mounted in axially spaced relation in the grooves of said body, each honing ring having an inside surface and being mounted independently of the others and axially and radially split entirely through the full cross section of said ring, said rings being mounted in said grooves with an annular clearance between said groove bottoms and the inside surface of said rings thereby enabling the rings to freely expand and contract within their respective grooves independently of one another, the outer diameter of each said ring when said ring is uncompressed being slightly greater than said bore whereby compression of said rings when positioned in said bore resiliently preloads said rings so that the outer peripheries of said rings exert working pressure on said bore, and means for rotating said tool body and thus said rings, the independent mounting and resilient preloading of each ring permitting one ring to move radially relative to the others so that each ring can adapt itself to the shape of the adjacent bore wall surface and exert resilient force thereon.

2. The honing tool of claim 1, wherein said plurality of honing rings are spaced equidistant from one another along an axial surface of said tool body.

3. The honing tool of claim 1, wherein each of said honing rings is mounted with an axially close clearance in an annular groove formed in the periphery of said tool body coaxially to said longitudinal axis.

4. The honing tool of claim 1, wherein each of said honing rings is locked from rotation with respect to said tool body.

5. The honing tool of claim 1, wherein an abrasive layer is located on an outer periphery of each of said honing rings.

6. The honing tool of claim 1, further comprising bristles mounted on an outer periphery of each of said honing rings.

7. The honing tool of claim 1, wherein each of said rings is mounted in an annular groove formed in the periphery of said tool coaxially to said longitudinal axis, and hydraulic coolant supply means for supplying hydraulic coolant under pressure to said grooves so as to apply additional radially outward pressure on said rings and thus the bore wall.

8. The honing tool of claim 7, wherein said coolant supply means supplies coolant uniformly to all of said grooves.

9. The honing tool of claim 7, wherein said tool body has an inner bore formed therein for receiving said coolant and supplying said coolant to annular channels formed at the bottom of each of said annular grooves, said coolant being discharged under pressure through a narrow gap located between said honing rings and the associated annular grooves.

10. The honing tool of claim 1, further comprising an enshrouding cylinder arranged coaxially with said cylindrical bore and having a frusto-conical shaped section adapted to compressively adjust the diameter of said honing rings to be approximately equal to that of said cylindrical bore before insertion of said honing tool into said cylindrical bore, said rings thereby being preloaded.

11. The honing tool of claim 10, further comprising a high-pressure liquid-jet device connected to said honing body for directing liquid under high pressure to the machined surface.

12. A method of machining a surface of a cylindrical bore by a honing tool comprised of a tool body having a longitudinal axis, said method comprising the steps of:

forming a plurality of axially spaced annular grooves in the periphery of said tool body, each groove having a groove bottom at the radially inner end thereof, mounting a resilient honing ring in each groove, each of said honing rings having an inside surface and being mounted independently of the others and being axially and radially split entirely through the full cross section of said ring, the rings being mounted in the grooves with an annular clearance between the bottoms of the grooves and the inside surfaces of the rings, thereby enabling the rings to freely expand and contract within their respective grooves independently of one another, the uncompressed outer diameter of said rings being slightly greater than the diameter of said bore, radially compressing said rings so as to preload the same, and positioning said tool body with said compressed rings in said bore, said rings resiliently engaging and thus exerting pressure on said bore, and rotating said tool body and thus said rings, the independent mounting of each ring permitting one ring to move radially relative to the others so that each ring can adapt itself to the shape of the adjacent bore wall surface and exert resilient force thereon.

13. The method of claim 12, further including the step of applying additional radially outward pressure on said rings by feeding hydraulic coolant under pressure to said honing rings from a hydraulic feed source.

14. The honing tool of claim 13, wherein said step of feeding hydraulic coolant further comprises the step of feeding said coolant uniformly through an inner bore of said honing tool body, through an annular channel formed at a base of each of said annular grooves, and through a fitting gap located between said honing ring and said annular groove.

15. The method of claim 12, further comprising the step of adjusting the diameter of said honing ring to be approximately equal to that of said cylindrical bore, before insertion said honing tool into said cylindrical bore, by forcing said tool body through a frusto-conical shaped section of an enshrouding cylinder arranged coaxially with said cylindrical bore.

* * * * *